US007921935B2

(12) United States Patent
Engelfried et al.

(10) Patent No.: US 7,921,935 B2
(45) Date of Patent: Apr. 12, 2011

(54) HANDHELD POWER TOOL WITH VIBRATION-DAMPED HANDLE

(75) Inventors: Uwe Engelfried, Ostfildern (DE); Lars Schmid, Nuertingen (DE); Johannes Schnitzler, Reutlingen (DE); Gerhard Meixner, Filderstadt (DE); Juergen Lennartz, Ostfildern (DE); Jan Koalick, Leinfelden (DE)

(73) Assignee: Robert Bosch GmbH, Stuttgart (DE)

( * ) Notice: Subject to any disclaimer, the term of this patent is extended or adjusted under 35 U.S.C. 154(b) by 59 days.

(21) Appl. No.: 11/916,572

(22) PCT Filed: Feb. 9, 2007

(86) PCT No.: PCT/EP2007/051250

§ 371 (c)(1),
(2), (4) Date: Dec. 5, 2007

(87) PCT Pub. No.: WO2007/115845

PCT Pub. Date: Oct. 18, 2007

(65) Prior Publication Data

US 2010/0025062 A1 Feb. 4, 2010

(30) Foreign Application Priority Data

Apr. 7, 2006 (DE) ..... 10 2006 016 442

(51) Int. Cl.
*B25F 17/04* (2006.01)

(52) U.S. Cl. ..... 173/162.2; 403/122

(58) Field of Classification Search ..... 173/162.2; 403/122, 133, 135, 140, 141, 143
See application file for complete search history.

(56) References Cited

U.S. PATENT DOCUMENTS

| | | | | |
|---|---|---|---|---|
| 3,322,211 | A | 5/1967 | Alabuzhev | |
| 3,805,302 | A * | 4/1974 | Mathys | 623/21.15 |
| 3,940,946 | A * | 3/1976 | Andersen | 464/89 |
| 4,282,938 | A | 8/1981 | Minamidate | |
| 4,338,038 | A * | 7/1982 | Cloarec | 403/56 |
| 4,571,110 | A * | 2/1986 | Amrath | 403/141 |
| 4,576,241 | A * | 3/1986 | Emonet | 173/162.2 |
| 4,591,276 | A * | 5/1986 | Schneider et al. | 384/206 |
| 4,796,325 | A * | 1/1989 | Bortman | 15/167.2 |
| 5,025,870 | A * | 6/1991 | Gantner | 173/162.2 |
| 5,052,500 | A * | 10/1991 | Ohtsu | 173/162.2 |
| 5,073,145 | A * | 12/1991 | Ratzokwski et al. | 464/157 |

(Continued)

FOREIGN PATENT DOCUMENTS

CN 1463214 12/2003

(Continued)

*Primary Examiner* — Rinaldi I Rada
*Assistant Examiner* — Gloria R Weeks
(74) *Attorney, Agent, or Firm* — Michael J. Striker

(57) ABSTRACT

The invention is based on a portable power tool having a vibration-damped handle (10) which has two legs (12, 14) running in the longitudinal direction (48) of the portable power tool and which is motionally coupled to its housing (28), wherein at least one lever (20, 22; 20*a*, 22*a*; 20*b*, 22*b*) oriented transversely to the longitudinal direction (48) is coupled to each of the two legs (12, 14) at an articulation point (16, 18; 16*a*, 18*a*), and wherein the levers (20, 22; 20*a*, 22*a*; 20*b*, 22*b*) are coupled to a joint region (50) lying between the two legs (12, 14) of the handle (10). It is proposed that each lever (20, 22; 20*a*, 22*a*; 20*b*, 22*b*) have a bearing point (24, 26; 24*a*, 20 26*a*; 24*b*, 26*b*) between the joint region (50) and the respective articulation point (16, 18; 16*a*, 18*a*).

10 Claims, 2 Drawing Sheets

U.S. PATENT DOCUMENTS

| | | | | |
|---|---|---|---|---|
| 5,314,221 | A * | 5/1994 | Hammer | 294/19.1 |
| 5,605,500 | A * | 2/1997 | Matechuk | 451/456 |
| 5,697,456 | A * | 12/1997 | Radle et al. | 173/162.2 |
| 5,987,709 | A * | 11/1999 | Chou | 24/116 A |
| 6,241,594 | B1 * | 6/2001 | Lepold | 451/359 |
| 6,314,617 | B1 * | 11/2001 | Hastings | 16/436 |
| 6,789,294 | B2 * | 9/2004 | Panek et al. | 16/409 |
| 6,902,344 | B2 * | 6/2005 | Raak et al. | 403/135 |
| 7,008,135 | B2 * | 3/2006 | Wisler et al. | 403/122 |
| 7,076,838 | B2 | 7/2006 | Meixner | |
| 7,100,703 | B2 * | 9/2006 | Etter | 172/315 |
| 2004/0040729 | A1 | 3/2004 | Meixner | |
| 2005/0013658 | A1 * | 1/2005 | Muders et al. | 403/122 |
| 2006/0185867 | A1 * | 8/2006 | Frauhammer et al. | 173/162.1 |
| 2008/0283261 | A1 * | 11/2008 | Schmid et al. | 173/162.2 |
| 2009/0025950 | A1 * | 1/2009 | Steinke et al. | 173/162.2 |
| 2009/0272553 | A1 * | 11/2009 | Engelfried et al. | 173/162.2 |
| 2010/0012339 | A1 * | 1/2010 | Hahn et al. | 173/162.2 |

FOREIGN PATENT DOCUMENTS

| | | |
|---|---|---|
| DE | 610 736 | 3/1935 |
| DE | 690 002 | 4/1940 |
| DE | 101 36 015 | 2/2003 |
| GB | 1 549 771 | 8/1979 |
| GB | 2 171 045 | 8/1986 |
| NL | 7607654 | 1/1977 |

* cited by examiner

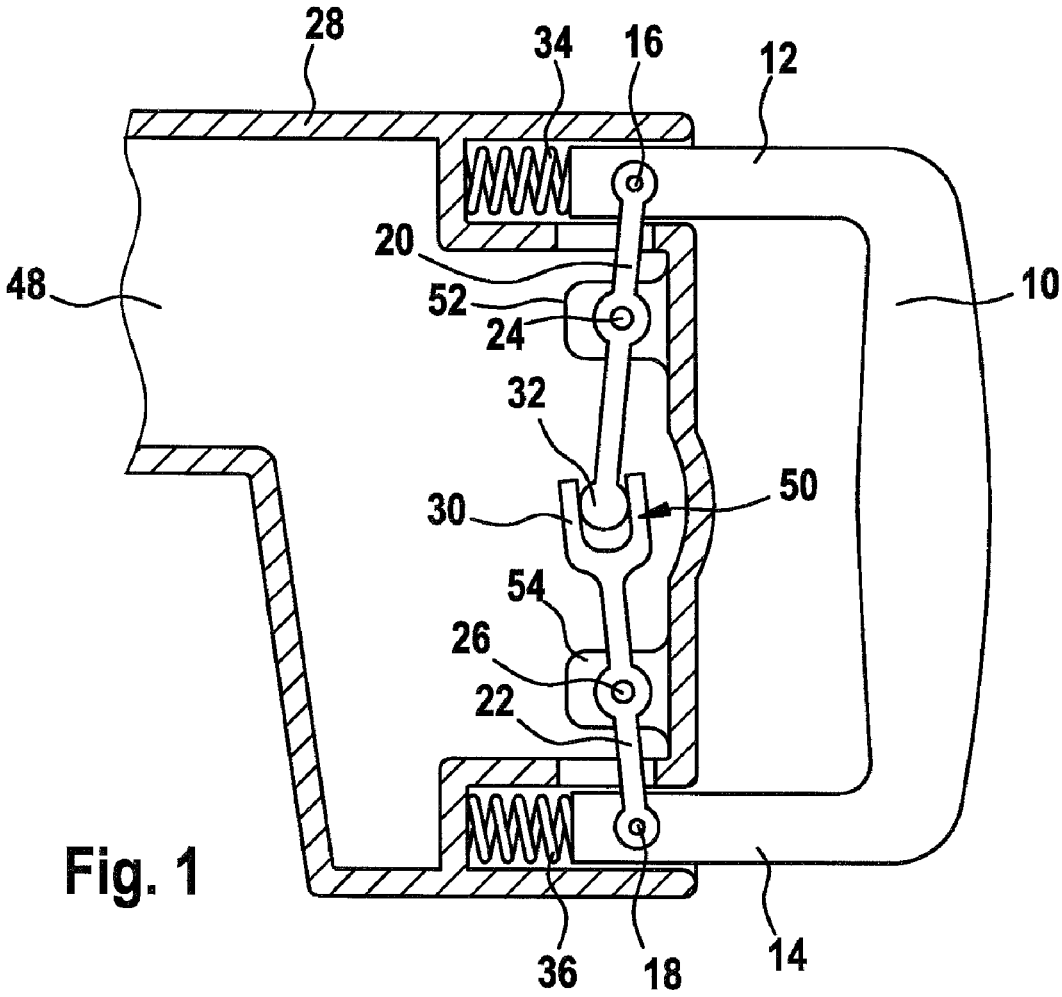
Fig. 1
Fig. 2
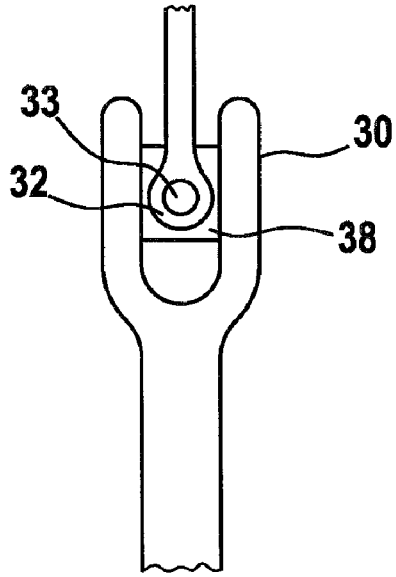

Fig. 3
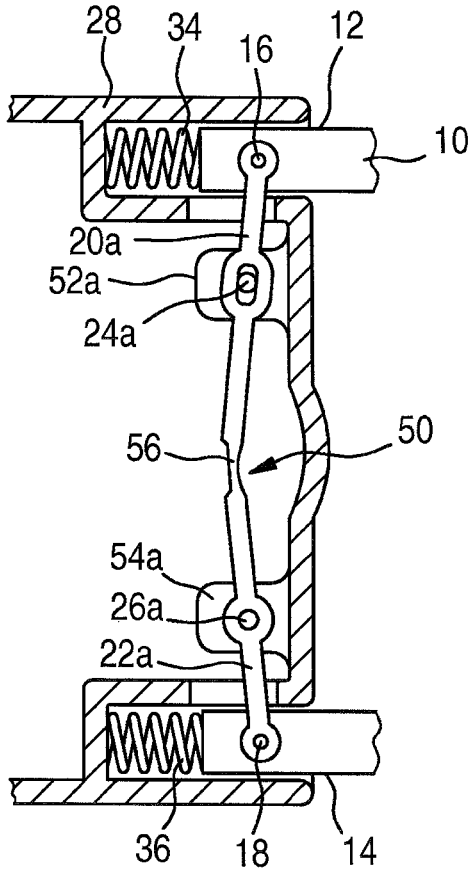
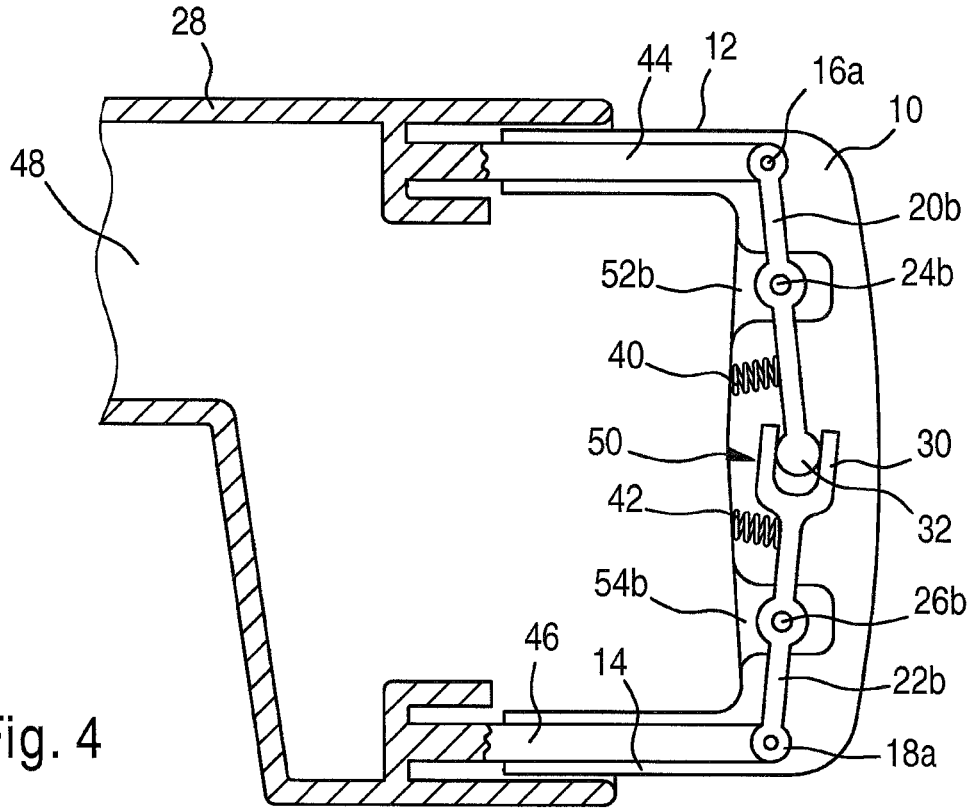
Fig. 4

HANDHELD POWER TOOL WITH VIBRATION-DAMPED HANDLE

CROSS-REFERENCE TO RELATED APPLICATION

The invention described and claimed hereinbelow is also described in German Patent Application DE 10 2006 016 442.3 filed on Apr. 7, 2006. This German Patent Application, whose subject matter is incorporated here by reference, provides the basis for a claim of priority of invention under 35 U.S.C. 119(a)-(d).

BACKGROUND OF THE INVENTION

Particularly in handheld power tools with a percussive drive, such as in drill hammers, chiseling hammers, and the like, relatively strong vibration occurs in the tool; it is transmitted to the handle of the tool and is not only unpleasant to the user but can even be harmful to health.

From German Patent Disclosure DE 101 36 015 A1, a handheld power tool is known, having a vibration-damped handle which has two legs, extending approximately parallel to the longitudinal direction of the handheld power tool, and is coupled resiliently to the tool housing. One lever, oriented essentially perpendicular to the longitudinal direction, is pivotably connected by one of its two ends to each of the two legs, and these levers are pivotably connected by their other ends to a tool housing joint region located between the two legs of the handle.

SUMMARY OF THE INVENTION

The invention is based on a handheld power tool with a vibration-damped handle, which handle has two legs, oriented in the longitudinal direction of the handheld power tool, and is coupled movably to the tool housing of the legs, and at least one lever, oriented transversely to the longitudinal direction, is pivotably connected to each of the two legs at an articulation point, and the levers are pivotably connected to a joint region located between the two legs of the handle. The term "extending in the longitudinal direction" should also be understood to mean orientations that form an angle with a longitudinal direction, preferably an angle of less than 30° and especially preferably less than 20°. Moreover, "oriented transversely to the longitudinal direction" should be understood in particular also to mean an orientation that forms an angle unequal to 90° with a longitudinal direction of the handheld power tool, such as preferably an angle between 110° and 70°, and especially preferably between 80° and 100°.

It is proposed that each lever, between the joint region and the respective articulation point, has a bearing point. This advantageously results in an improved practical implementation of vibration damping. The handle is given linear guidance, which is economical and low in friction. A very compact design is also achieved. Because the levers are each connected to the housing or to the handle by way of only one bearing point, the handle is very strongly decoupled from tool housing vibration. Furthermore, the handle with the lever construction gains quite high stability. By the incorporation of a resilient element, effective vibration damping is attained. The user is protected against harmful and/or annoying vibration. Moreover, handling of the handheld power tool is made easier. The handheld power tool is preferably an electric power tool, in particular a drill hammer, chiseling hammer, and the like.

In a coordinate aspect of the invention, the point of departure is a handheld power tool with a vibration-damped handle, which handle has two legs, oriented in the longitudinal direction of the handheld power tool, and is coupled movably to the tool housing of the legs, and at least one lever, oriented transversely to the longitudinal direction, is pivotably connected to each of the two legs at an articulation point, and the levers are pivotably connected to a joint region located between the two legs of the handle.

It is proposed that each lever, between the joint region and the respective articulation point, has a bearing point located on the handle end. Once again, a very compact design is advantageously obtained. Especially advantageously, the bearing point can be located inside the housing.

The levers may be braced with spring force on the handle. To that end, one, two, or more spring elements may be provided, which may be embodied either passively as conventional springs or actively in the form of suitable actuators. Expediently, it is provided that the levers are located inside the handle. This advantageously makes for a perceptible reduction in the amount of space required for the vibration damping.

In a favorable embodiment, the two levers may merge in one piece with one another. The joint region between the legs, in this embodiment, may be embodied as an elastic connection tongue. Expediently, at least one of the bearing points then makes a longitudinal compensation possible.

If the two legs of the handle, in the aforementioned joint region, are pivotably connected via a fork and a ball-like body that engages it, favorable movability of the lever connection is possible. For improved wear resistance, a sliding block may be located between the fork and the ball-like body; the ball-like body is pivotably secured to the sliding block and can slide in the fork when the ball-like body moves up and down.

It is advantageous if the handle can be braced on the housing by spring force. The handle is supported in such a way that it is extensively free of friction and it can execute a longitudinal motion in the direction of a primary vibration direction of a handheld power tool. A further advantageous embodiment for vibration damping of the handle is that one or more electrically controllable or regulatable actuators are located between the handle and the tool housing and damp vibration of the handle by counteracting a force or motion that occurs as a result of the vibration of the tool housing.

Further advantages will become apparent from the ensuing description of the drawings. In the drawings, exemplary embodiments of the invention are shown. The drawings, description, and claims include numerous characteristics in combination. One skilled in the art will expediently consider them individually as well and put them together to make useful further combinations.

BRIEF DESCRIPTION OF THE DRAWINGS

FIG. 1, a detail of a preferred handheld power tool with a vibration-damped handle, in a sectional view;

FIG. 2, a detail of the vibration damper of FIG. 1;

FIG. 3, an alternative embodiment with one-piece levers; and

FIG. 4, a variant of a vibration damper that is located in a handle.

DESCRIPTION OF THE PREFERRED EMBODIMENTS

Elements that remain essentially the same are identified throughout by the same reference numerals.

FIG. 1 shows a detail of a handheld power tool, not shown further in the drawings, with a vibration-damped handle 10 that has two legs 12, 14, extending in the longitudinal direction 48 of the handheld power tool, and that is coupled resiliently to the housing 28.

One lever 20, oriented transversely, in this case essentially perpendicular, to the longitudinal direction 48 of the handheld power tool is pivotably connected by one of its two ends to one leg 12 at a articulation point 16 and by its other end to a joint region 50 located between the legs 12 and 14 of the handle 10. Symmetrically to it, a lever 22 of the same kind is pivotably connected by one end to the other leg 14 at an articulation point 18 and is likewise pivotably connected by its other end in the joint region 50. The levers 20, 22 extend through openings, not identified by reference numeral, in the housing 28 to the articulation points 16 and 18 on the respective legs 12 and 14. In principle, however, an asymmetrical design is also conceivable, for instance with legs and/or levers of different lengths, so that in particular, a handle motion can be attained that deviates from a handle motion oriented in the longitudinal direction and can in particular be oriented to special vibration directions.

In the joint region 50, on the end of one lever 22, a fork 30 is embodied, which is engaged by one end, embodied as a ball-like body 32, of the other lever 20 and is retained movably therein, in particular in a height-adjustable and tiltable fashion.

Each leg 12 and 14, between the joint region 50 and the respective articulation point 16 and 18, has a respective bearing point 24 and 26 on the housing end, by way of which bearing point the respective lever 20, 22 is connected to the housing 28 and about which the respective levers 20 and 22 are pivotable. To that end, a pivot peg structurally connected to the housing engages a bore in the respective lever 20 and 22. To enable the necessary pivoting motion of the levers 20, 22, suitable recesses 52, 54 are provided as free spaces in the housing 28. In principle, a reverse disposition would also be conceivable.

The resilient coupling of the handle 10 to the housing 28 is attained by providing that the handle 10 is braced with its respective legs 12, 14 on the housing 28 via spring elements 34 and 36, preferably embodied as compression springs, that extend parallel to the longitudinal direction 48; the legs 12, 14 dip into corresponding channel-like guides, not identified by reference numeral, in the housing.

The spring elements 34, 36 keep the handle 10 in its rear position, remote from the tool (toward the right in the drawing). If manual force is exerted on the handle 10, the handle moves in the direction of the housing 28, until the manual force and the spring force of the spring elements 34, 36 balance one another. The handle 10 is thus insulated in terms of vibration from the housing 28.

As FIG. 2 shows, a function of the fork 30 of the device in FIG. 1 can be improved in terms of its wear resistance by locating the ball-like body 32 pivotably about a pivot point 33 on a sliding block 38 located in the fork 30. The sliding block 38 makes a low-wear up-and-down motion of the ball-like body 32 in the fork 30 possible.

A variant of the invention can be seen in FIG. 3. With regard to characteristics and functions, which remain the same, of elements not further explained, reference may be had to the description in the exemplary embodiment of FIGS. 1 and 2. To distinguish among the exemplary embodiments, letters are appended to some reference numerals for the elements involved.

Two levers 20*a*, 22*a*, pivotably connected to legs 12, 14 of the handle 10, are embodied in one piece and are connected to one another via an elastic connection tongue 56 in the joint region 50. The two ends, toward one another, of the levers 20*a*, 22*a* are pivotably connected to the elastic joint of the connection tongue 56, which replaces the fork connection of the preceding embodiments. Once again, the respective bearing points 24*a*, 26*a*, as in the embodiment of FIG. 1, are located on the housing end, and at least one bearing point 24*a* makes a longitudinal compensation possible by the provision of an oblong slot in the lever 20*a*, which slot is engaged by the pivot pin structurally connected to the housing.

FIG. 4 illustrates a variant in which levers 20*b*, 22*b* are located inside the handle 10, by way of a pivot connection in the joint region 50 between legs 12, 14 of a handle 10. The bearing points 24*b*, 26*b* are now located in the handle 10 on the handle end, and the respective levers 20*b*, 22*b* are braced on the handle 10 by spring force via spring elements 40 and 42 preferably embodied as compression springs.

The end of the levers 20*b*, 22*b* remote from the fork or from the ball-like body 32 is pivotably connected to a peg 44 and 46, respectively.

For the motion of the levers 20*b*, 22*b* about the bearing points 24*b*, 26*b*, suitable articulations in the handle 10 are provided.

The invention claimed is:

1. A handheld power tool with a vibration-damped handle (10), which handle has two legs (12, 14), oriented in a longitudinal direction (48) of the handheld power tool, and is coupled movably to a tool housing (28) of the legs, and at least one lever (20, 22; 20*a*, 22*a*; 20*b*, 22*b*), oriented transversely to the longitudinal direction (48), is pivotably connected to each of the two legs (12, 14) at an articulation point (16, 18; 16*a*, 18*a*), and the levers (20, 22; 20*a*, 22*a*; 20*b*, 22*b*) are pivotably connected to a joint region (50) located between the two legs (12, 14) of the handle (10), wherein each lever (20, 22; 20*a*, 22*a*; 20*b*, 22*b*), between the joint region (50) and the respective articulation point (16, 18; 16*a*, 18*a*), has a bearing point (24, 26; 24*a*, 26*a*; 24*b*, 26*b*), and wherein either the levers (20, 22; 20*a*, 22*a*; 20*e*, 22*e*) are braced by spring force on the handle (10), or the handle (10) is braced by spring force on the housing (28), wherein each of said levers (20, 22; 20*a*, 22*a*; 20*b*, 22*b*) is a two-arms lever and has a first elongated arm extending in a transverse direction transversely to the longitudinal direction and a second elongated arm extending in said transverse direction, wherein said first arm of each of said two-arms levers has one end connected with a respective one of said two legs, wherein said second arms of said two-arms levers have second ends pivotally connected with one another in the joint region, and wherein said first and second arms of each of said two-arms levers are connected with one another in the bearing point, which bearing point in each of said two-arms levers is spaced in said transverse direction from said first end of said first arm and from said second end of said second arm.

2. The handheld power tool as defined by claim 1, wherein the bearing point (24, 26; 24*a*, 26*a*) is located on a housing end.

3. The handheld power tool as defined by claim 1, wherein the bearing point (24*b*, 26*b*) is located on the handle end.

4. The handheld power tool as defined by claim 3, wherein the levers (20*b*, 22*b*) are located inside the handle (10).

5. The handheld power tool as defined by claim 1, wherein the two levers (20*a*, 22*a*) merge in one piece with one another.

6. The handheld power tool as defined by claim 5, wherein the joint region (50) is embodied as an elastic connection tongue (56).

7. The handheld power tool as defined by claim 5, wherein at least one of the bearing points (24*a*) makes a longitudinal compensation possible.

8. The handheld power tool as defined by claim 1, wherein the two legs (12, 14) of the handle (10) are pivotably connected in the joint region (50) via a fork (30) and a ball-like body (32).

9. The handheld power tool as defined by claim 8, wherein a sliding block (38) is located between the fork (30) and the ball-like body (32).

10. A handheld power tool with a vibration-damped handle (10), which handle has two legs (12, 14), oriented in a longitudinal direction (48) of the handheld power tool, and is coupled movably to a tool housing (28) of the legs, and at least one lever (20, 22; 20*a*, 22*a*; 20*b*, 22*b*), oriented transversely to the longitudinal direction (48), is pivotably connected to each of the two legs (12, 14) at an articulation point (16, 18; 16*a*, 18*a*), and the levers (20, 22; 20*a*, 22*a*; 20*b*, 22*b*) are pivotably connected to a joint region (50) located between the two legs (12, 14) of the handle (10), wherein each lever (20, 22; 20*a*, 22*a*; 20*b*, 22*b*), between the joint region (50) and the respective articulation point (16, 18; 16*a*, 18*a*), has a bearing point (24, 26; 24*a*, 26*a*; 24*b*, 26*b*), and wherein either the levers (20, 22; 20*a*, 22*a*; 20*e*, 22*e*) are braced by spring force on the handle or the handle (10) is braced by spring force on the housing (28), further comprising two recesses (52, 54; 52*a*, 54*a*; 52*b*, 54*b*) provided in a component selected from the group consisting of the handle and the housing for allowing pivotal motion of the levers, wherein the recesses are spaced from one another in the transverse direction, are spaced from the joint region in the transverse direction, and are spaced from the articulation points in the transverse direction, and wherein each of the bearing points located between the joint region and the respective articulation point is located in a region of a respective one of said recesses.

* * * * *